US008303138B1

(12) United States Patent
Huang

(10) Patent No.: US 8,303,138 B1
(45) Date of Patent: Nov. 6, 2012

(54) LED LAMP HOLDER

(76) Inventor: Tsung-Hsien Huang, I-Lan Hsien (TW)

( * ) Notice: Subject to any disclaimer, the term of this patent is extended or adjusted under 35 U.S.C. 154(b) by 0 days.

(21) Appl. No.: 13/438,264

(22) Filed: Apr. 3, 2012

(30) Foreign Application Priority Data

Dec. 31, 2011 (CN) ..... 2011 1 0457847

(51) Int. Cl.
*F21V 29/00* (2006.01)

(52) U.S. Cl. ..... 362/294; 362/249.02; 362/311.02

(58) Field of Classification Search ..... 362/230, 362/249.02, 294, 311.02
See application file for complete search history.

(56) References Cited

U.S. PATENT DOCUMENTS 7,119,422 B2 * 10/2006 Chin ..... 362/294
2009/0175041 A1 * 7/2009 Yuen et al. ..... 362/294
2012/0057371 A1 * 3/2012 Kai et al. ..... 362/646
2012/0224371 A1 * 9/2012 Hsueh ..... 362/235

* cited by examiner

*Primary Examiner* — David V Bruce
(74) *Attorney, Agent, or Firm* — Pai Patent & Trademark Law Firm; Chao-Chang David Pai

(57) ABSTRACT

A LED lamp holder includes a heat sink made of aluminum or copper by stretching molding and defining opposing recessed top end and hollow bottom end, one or a number of LED chips mounted in the recessed top end of the heat sink and adapted for emitting light, and a light transmissive lampshade fastened to the recessed top end of the heat sink by a hook joint or screw joint, or by means of adhesive bonding. The heat sink can be configured to provide a hollow block in the recessed top end thereof for holding multiple LED chips on multiple peripheral walls thereof.

7 Claims, 10 Drawing Sheets

LED LAMP HOLDER

CROSS REFERENCE TO RELATED APPLICATIONS

This application is based upon and claims the benefit of priority from the prior China Patent Application No. 201110457847.9, filed on Dec. 31, 2011, the entire contents of which are incorporated herein by reference.

BACKGROUND OF THE INVENTION (a) Field of the Invention

The present invention relates to LED lamp technology and more particularly, to a LED lamp holder, which comprises a heat sink made of aluminum or copper by stretching molding and defining opposing recessed top end and hollow bottom end, at least one LED chip mounted in the recessed top end of the heat sink, and a light transmissive lampshade fastened to the recessed top end of the heat sink.

(b) Description of the Prior Art

A conventional LED lamp holder is known comprising a heat sink, a LED mount, at least one LED chip, and a lampshade. The heat sink is shaped like a double open-end shell member, having an inside annular groove located on the inside wall of the relatively bigger top end thereof. The LED mount has a substantially ⊓-shaped cross section, and is directly adhered to the inside annular groove of the top end of the heat sink to hold the at least one LED chip. The lampshade is bonded to the top end of the heat sink over the LED mount. Further, a lamp base is fastened to the hollow bottom end of the heat sink for electrically connecting the LED lamp holder to an electric outlet.

According to the aforesaid prior art design of LED lamp holder, the connection between the heat sink and the LED mount is achieved simply by an adhesive. The heat sink and the LED mount may be loosed easily after a long use, affecting structural stability. Further, the waste heat emitted by the at least one LED chip is transferred through the LED mount to the heat sink for dissipation. This indirect heat dissipation method is less effective.

SUMMARY OF THE INVENTION

The present invention has been accomplished under the circumstances in view. It is the main object of the present invention to provide a LED lamp holder, which comprises a heat sink made of a metal material by stretching molding and defining opposing recessed top end and hollow bottom end, at least one LED chip mounted in the recessed top end of the heat sink and adapted for emitting light, and a light transmissive lampshade fastened to the recessed top end of the heat sink.

As the recessed top end of the heat sink is formed integral with the hollow bottom end of the heat sink, it will not vibrate or disconnect from the heat sink. During operation, heat emitted by the at least one LED chip can be directly transferred to the heat sink and then quickly dissipated into the outside open air. Thus, the LED lamp holder has a compact structure easy to assemble and provides a heat dissipation function.

Further, in one embodiment of the present invention, the heat sink comprises a plurality of mounting holes disposed in the recessed top end around the border thereof; the lampshade comprises a plurality of hooks respectively hooked in the mounting holes of the heat sink.

Further, the heat sink comprises at least one tie hole disposed in the recessed top end, and at least one tie screw respectively mounted in the at least one tie hole to affix a lamp base to the hollow bottom end of the heat sink.

In another embodiment of the present invention, the heat sink comprises a hollow block disposed in the recessed top end. The hollow block defines a plurality of peripheral walls each holding one respective LED chip.

DETAILED DESCRIPTION OF THE PREFERRED EMBODIMENTS

Figure 1:
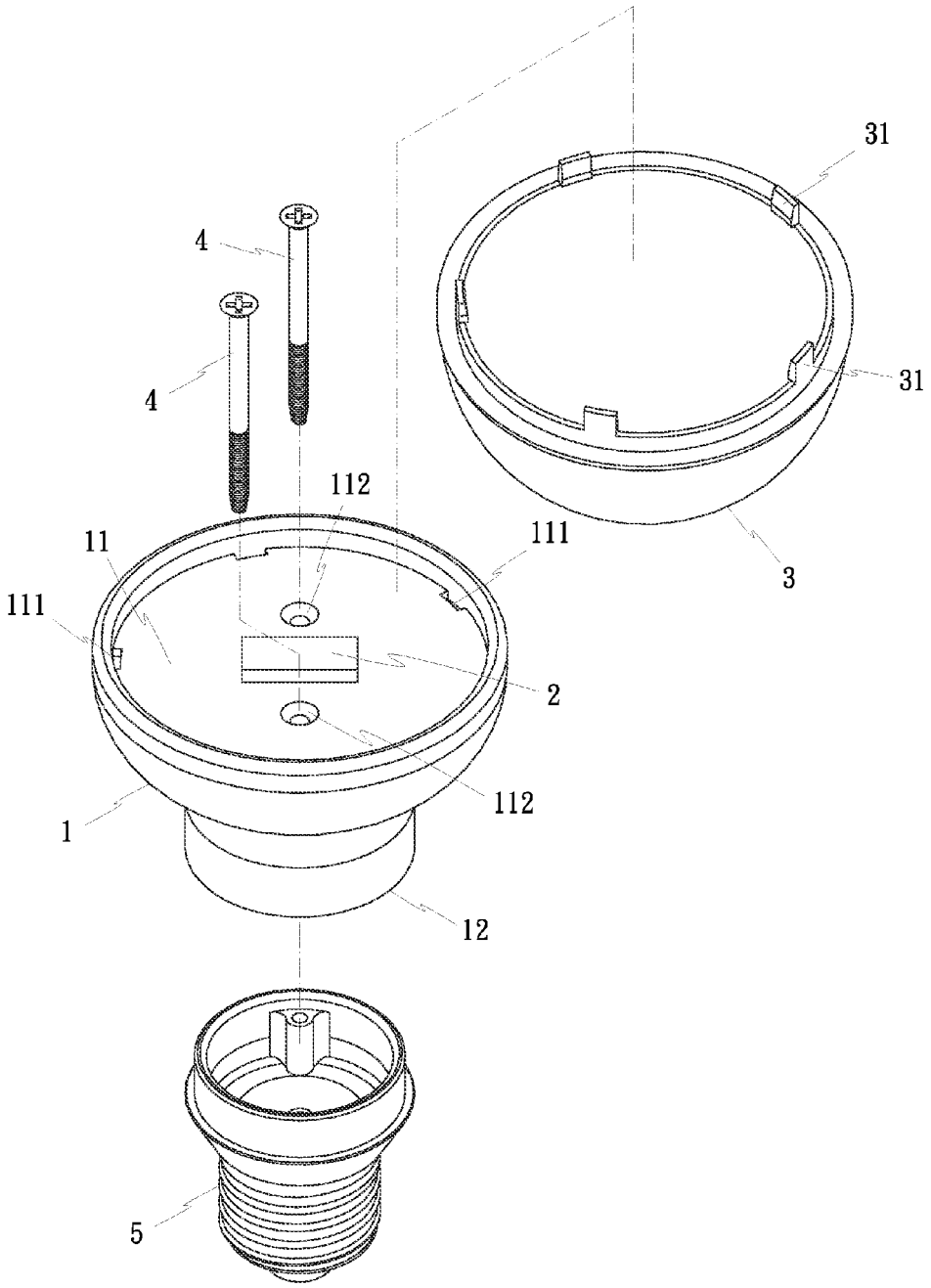
FIG. 1 is an exploded view of a LED lamp holder in accordance with a first embodiment of the present invention.
Figure 2:
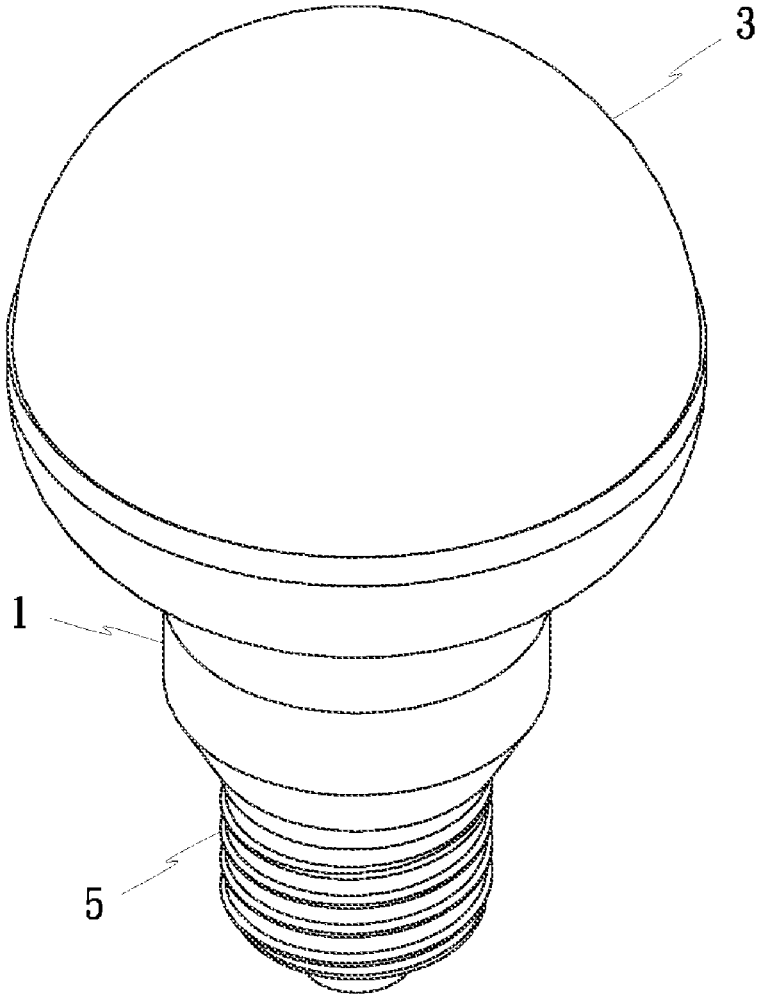
FIG. 2 is an elevational view of the LED lamp holder in accordance with the first embodiment of the present invention.
Figure 3:
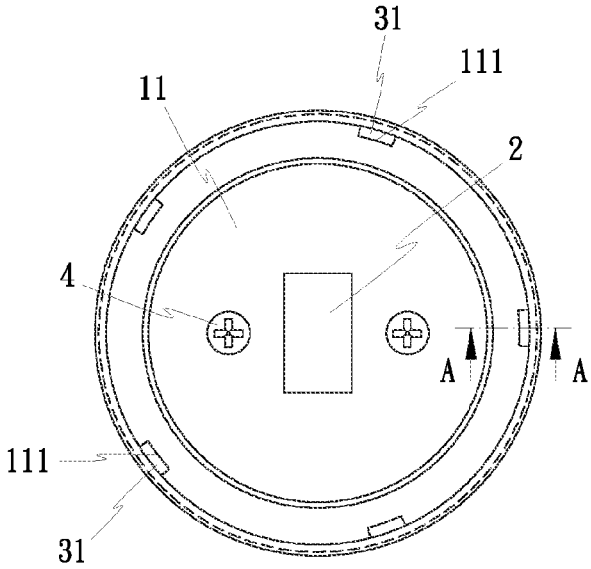
FIG. 3 is a schematic top view of assembly view of the LED lamp holder in accordance with the first embodiment of the present invention.
Figure 4:
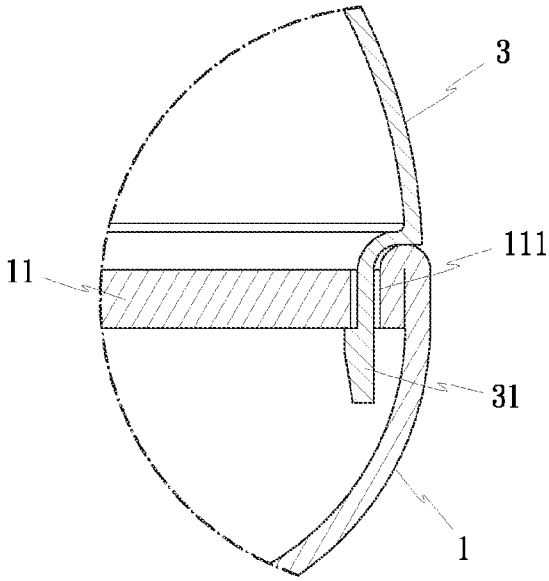
FIG. 4 is a sectional view, in an enlarged scale, taken along line A-A of FIG. 3.
Figure 5:
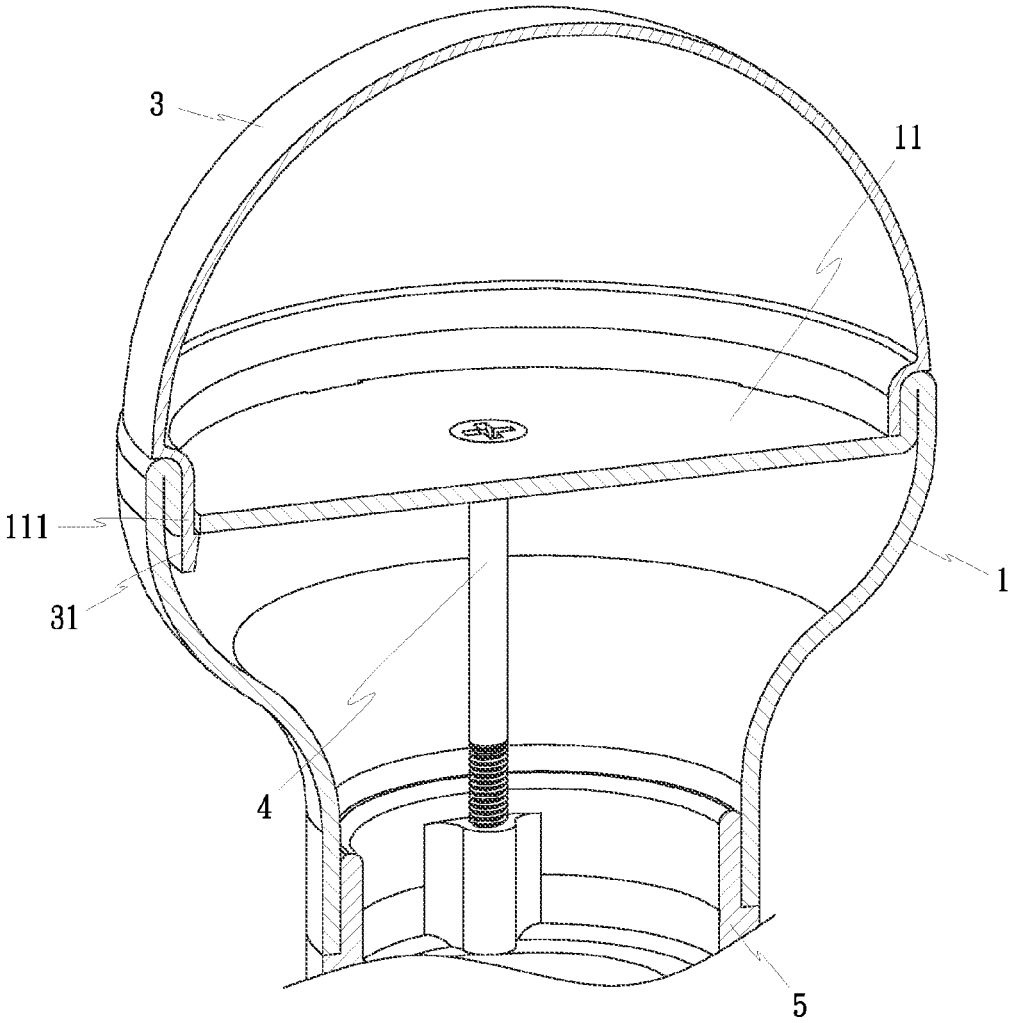
FIG. 5 is a sectional elevation of the LED lamp holder in accordance with the first embodiment of the present invention.

Referring to FIGS. 1-5, a LED lamp holder 10 in accordance with a first embodiment of the present invention is shown. The LED lamp holder comprises a heat sink 1, at least one LED (light-emitting diode) chip 2, and a lampshade 3.

The heat sink 1 is made of aluminum (or copper) by stretch forming technology, comprising opposing recessed top end 11 and hollow bottom end 12, a plurality of mounting holes 111 disposed in the recessed top end 11 and spaced around the border area, and a plurality of tie holes 112 located on the recessed top end 11 for the mounting of respective tie screws 4 to affix a lamp base 5 to the hollow bottom end 12. The top end 11 is a The at least one LED chip 2 mounted in the recessed top end 11 of the heat sink 1.

The lampshade 3 is a light transmissive member made of, for example, but not limited to, glass or plastics, comprising a plurality of mounting hooks 31 respectively hooked in the mounting holes 111 of the heat sink 1.

During installation, tie screws 4 are respectively mounted in the tie holes 112 of the heat sink 1 to affix a lamp base 5 to the hollow bottom end 12, and then the lampshade 3 is capped on the recessed top end 11 of the heat sink 1 by hooking the respective mounting hooks 31 in the respective mounting holes 111 of the heat sink 1. As the recessed top end 11 is formed integral with the heat sink 1, it will not vibrate or disconnect from the heat sink 1. During operation, heat emitted by the at least one LED chip 2 can be directly transferred to the heat sink 1 and then quickly dissipated into the outside open air. Thus, the LED lamp holder has a compact structure easy to assemble and provides a heat dissipation function.

Figure 6:
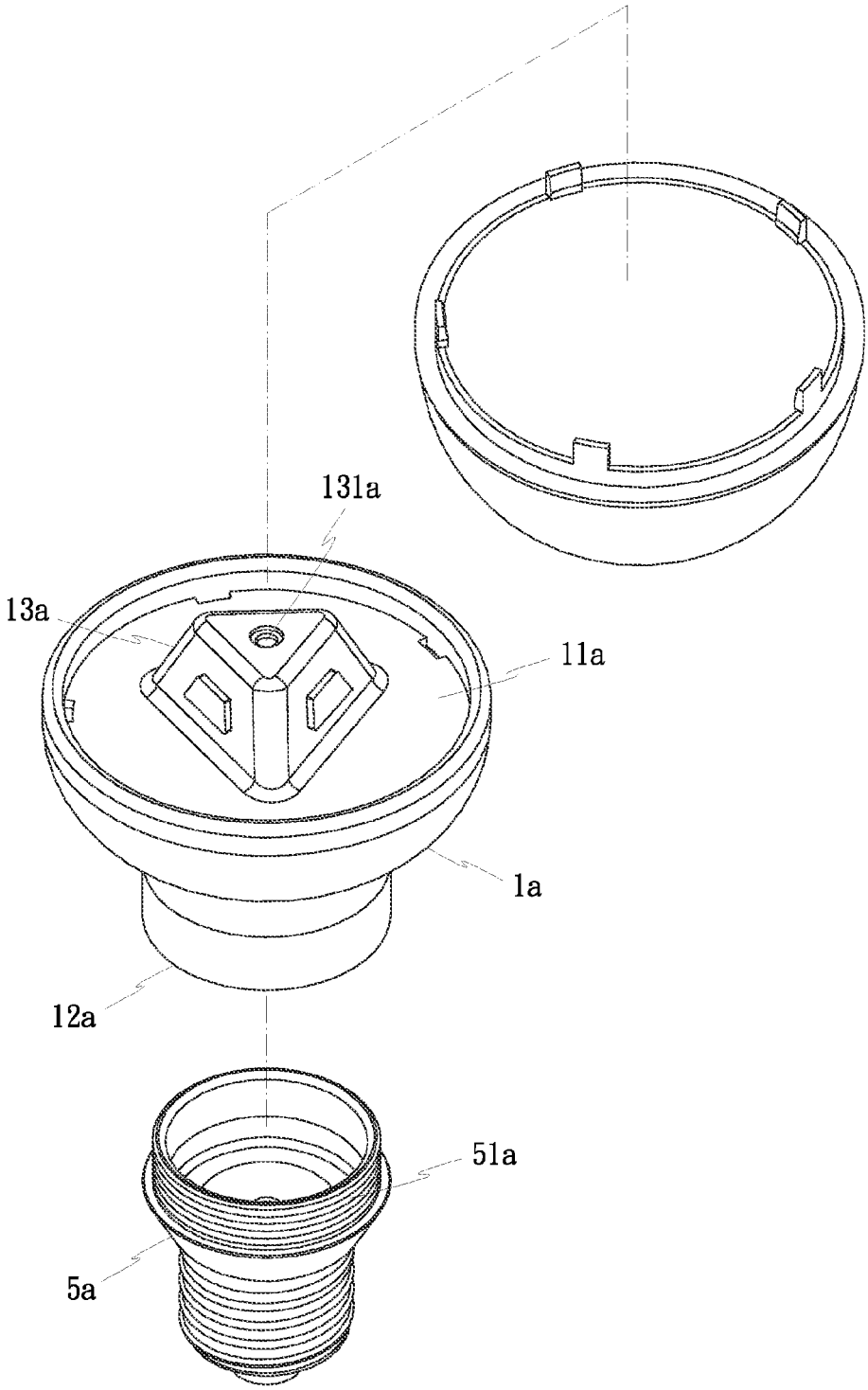
FIG. 6 is an exploded view of a LED lamp holder in accordance with a second embodiment of the present invention.
Figure 7:
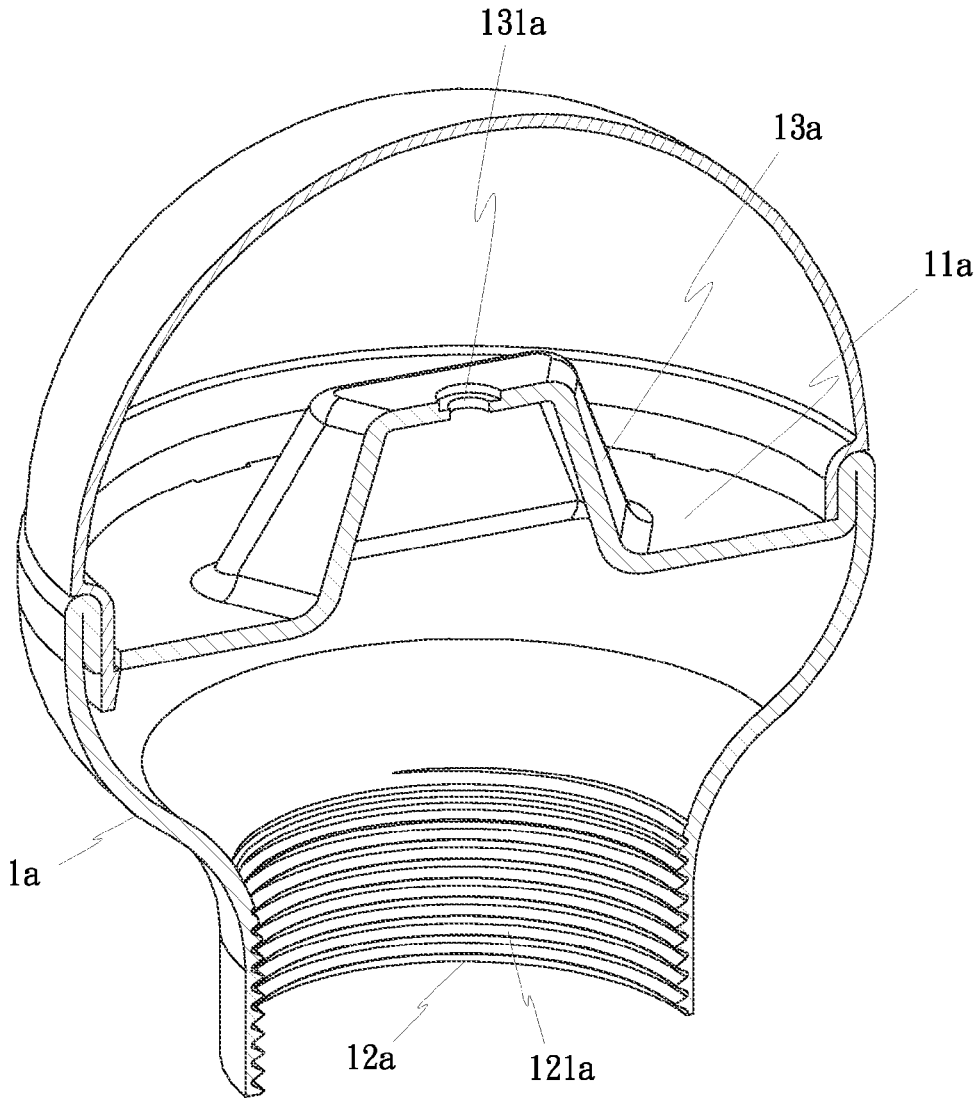
FIG. 7 is a sectional elevation, in an enlarged scale, of the LED lamp holder in accordance with the second embodiment of the present invention (the lamp base excluded).

FIGS. 6 and 7 illustrate a LED lamp holder 10 in accordance with a second embodiment of the present invention. This second embodiment is substantially similar to the aforesaid first embodiment with the exception of the heat sink design. According to this second embodiment, the heat sink, referenced by 1*a*, comprises opposing recessed top end 11*a* and hollow bottom end 12*a*, a hollow block 13*a* disposed in the recessed top end 11, and a wire hole 131*a* located on the top side of the hollow block 13*a* for the passing of lead wires of the LED chips 2. The hollow block 13*a* defines multiple peripheral walls for the mounting of LED chips 2.

Further, the hollow bottom end 12*a* of the heat sink 1*a* has inner threads 121*a* located on the inside wall thereof. The lamp base, referenced by 5*a*, has outer threads 51*a* for engagement with the inner threads 121*a* of the heat sink 1*a*. Thus, the lamp base 5*a* can be directly fastened to the hollow bottom end 12*a* of the heat sink 1*a* by a threading method.

Based on the spirit of the design of the present invention, an adhesive bonding technique or any other suitable measure may be employed to fasten the heat sink 1 (or 1*a*) and the lampshade 3 together instead of the arrangement of mounting hooks 31 and mounting holes 111.

Figure 8:
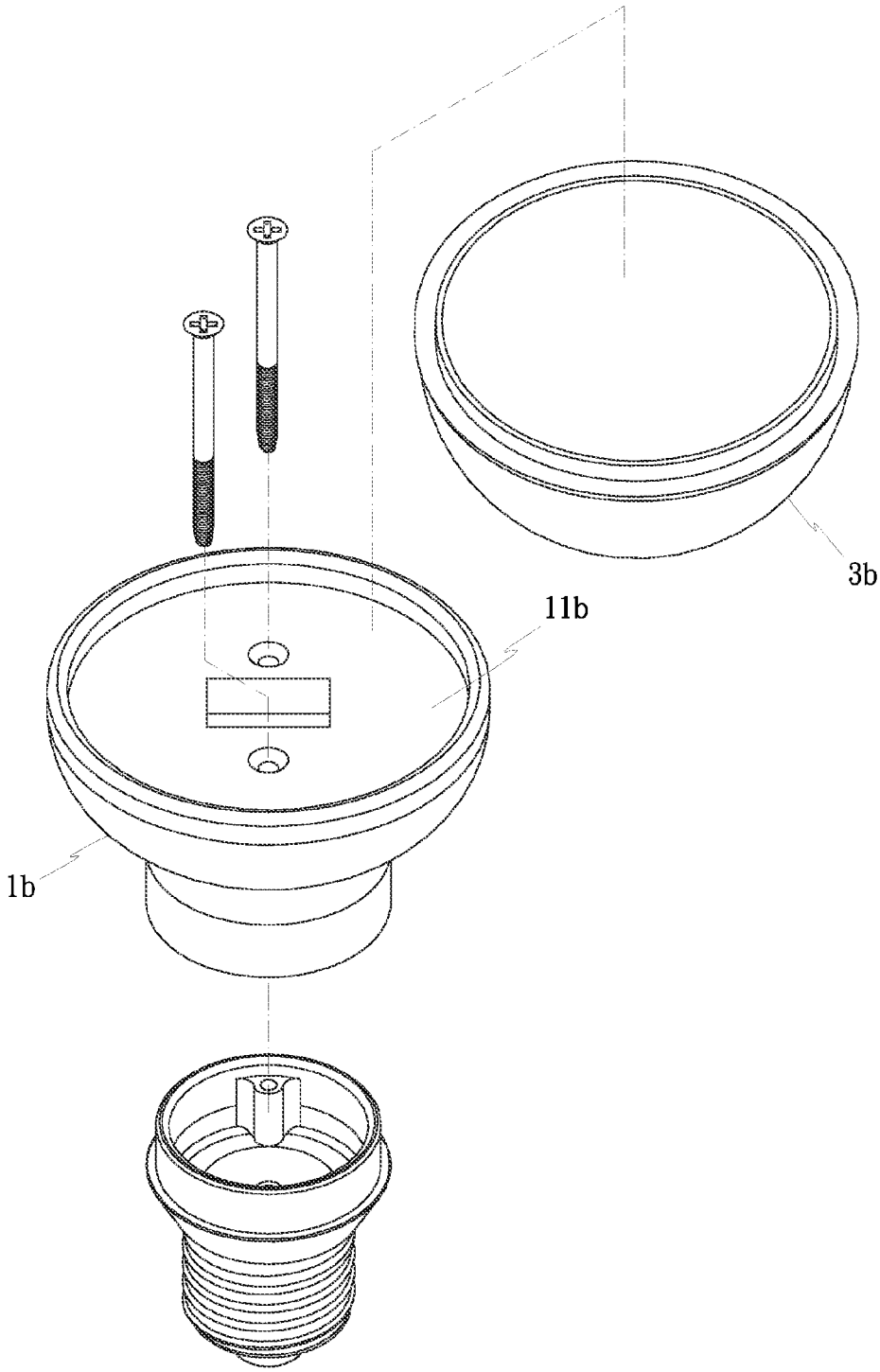
FIG. 8 is an exploded view of a LED lamp holder in accordance with a third embodiment of the present invention.
Figure 9:
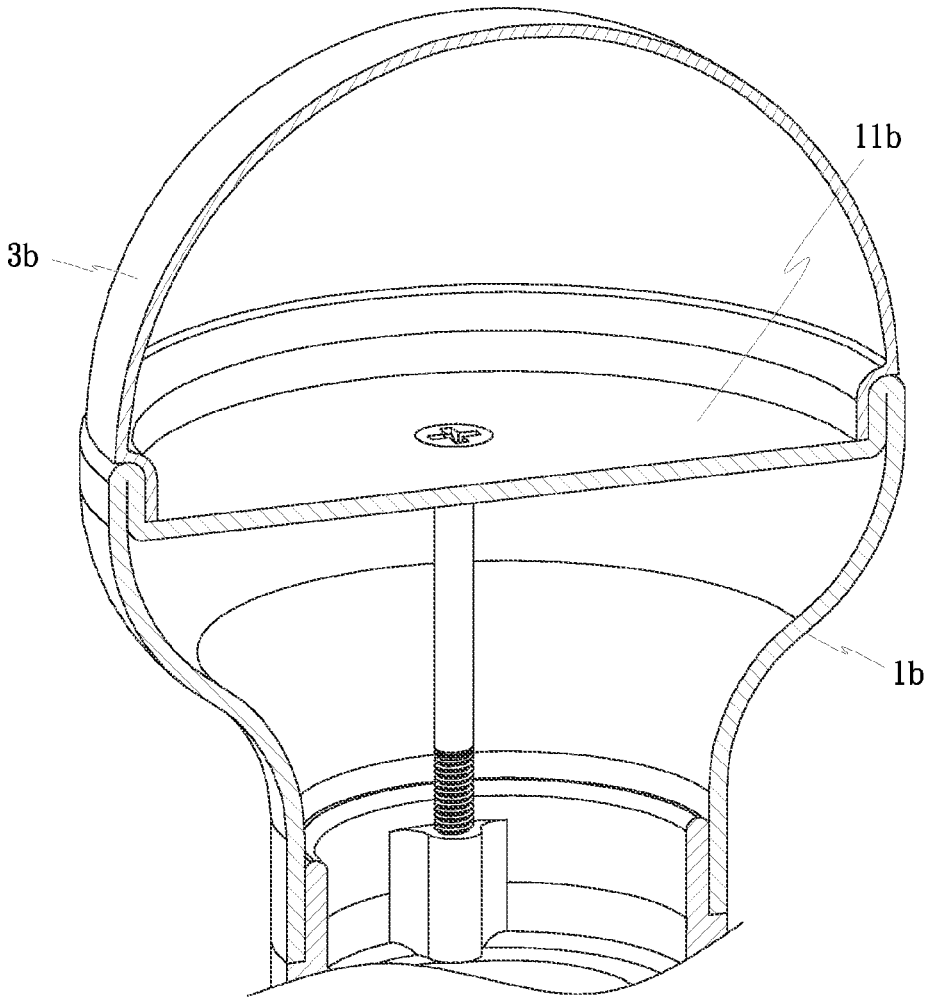
FIG. 9 is a sectional elevation, in an enlarged scale, of the LED lamp holder in accordance with the third embodiment of the present invention (the lamp base excluded).

FIGS. 8 and 9 illustrate a LED lamp holder in accordance with a third embodiment of the present invention. This third embodiment is substantially similar to the aforesaid first embodiment with the exception of the coupling structure between the heat sink 1*b* and the lampshade 3*b*. According to this third embodiment, the lampshade 3*b* is flanged; the recessed top end 11*b* of the heat sink 1*b* eliminates the aforesaid mounting holes 111 and is configured for the coupling of the flanged lampshade 3*b* directly.

Figure 10:
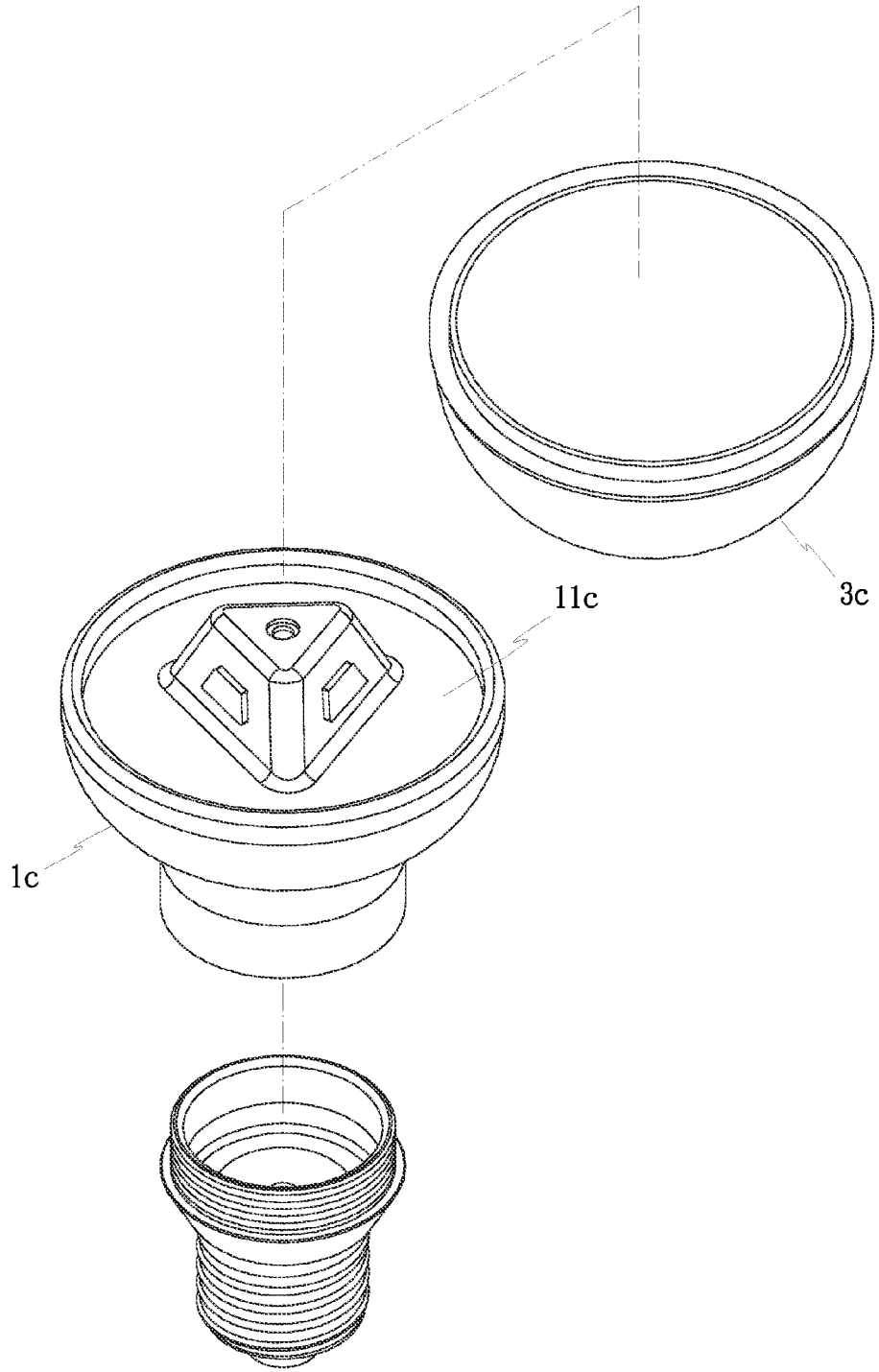
FIG. 10 is an exploded view of a LED lamp holder in accordance with a fourth embodiment of the present invention.
Figure 11:
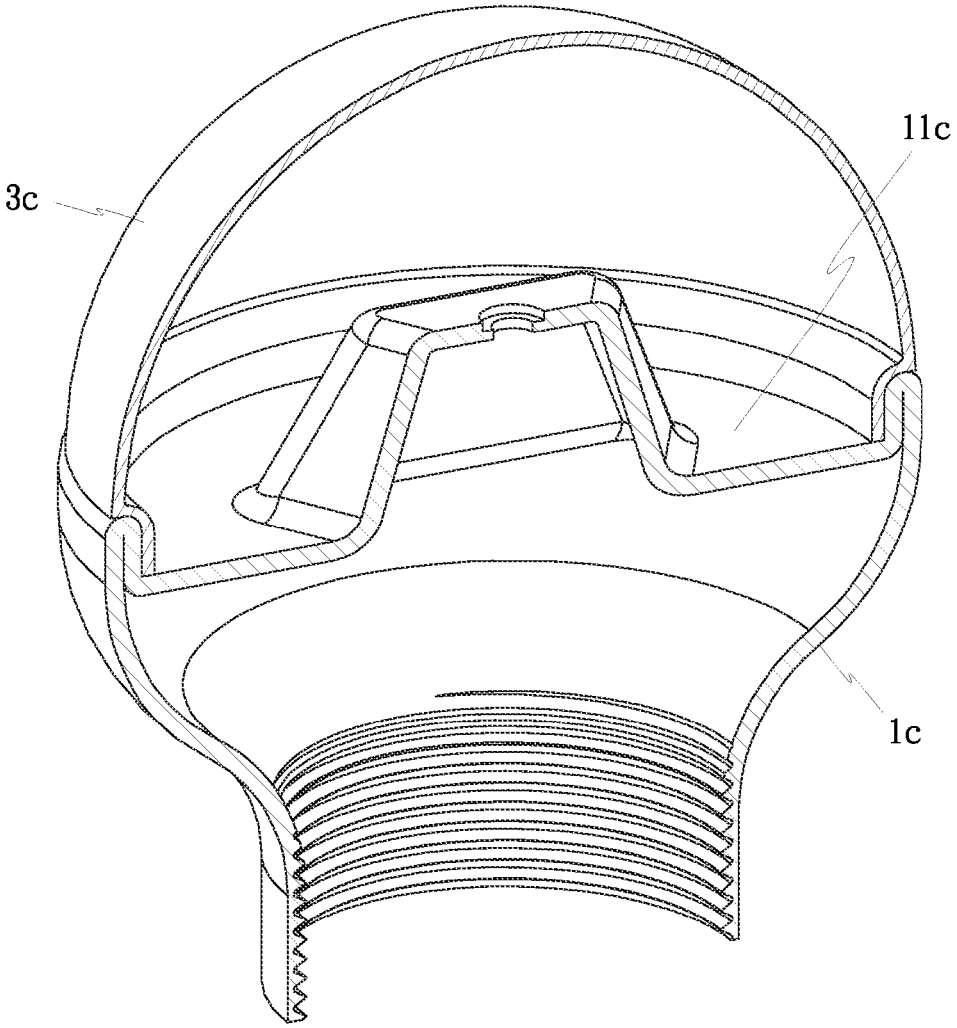
FIG. 11 is a sectional elevation, in an enlarged scale, of the LED lamp holder in accordance with the fourth embodiment of the present invention (the lamp base excluded).

FIGS. 10 and 11 illustrate a LED lamp holder in accordance with a fourth embodiment of the present invention. This fourth embodiment is substantially similar to the aforesaid second embodiment shown in FIGS. 6 and 7 with the exception of the coupling structure between the heat sink 1*b* and the lampshade 3*b*. According to this fourth embodiment, the lampshade 3*b* is flanged; the recessed top end 11*b* of the heat sink 1*b* eliminates the aforesaid mounting holes 111 and is configured for the coupling of the flanged lampshade 3*b* directly.

As stated above, the heat sink and lampshade of the LED lamp holder in accordance with the present invention can be fastened together by a hook joint or screw joint, or by adhesive bonding.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A LED lamp holder, comprising:

a heat sink made of a metal material by stretching molding, said heat sink comprising opposing recessed top end and hollow bottom end;

at least one LED chip mounted in said recessed top end of said heat sink and adapted for emitting light; and a lampshade being light transmissive and fastened to said recessed top end of said heat sink.

2. The LED lamp holder as claimed in claim 1, wherein said heat sink comprises a plurality of mounting holes disposed in said recessed top end around the border thereof; said lampshade comprises a plurality of hooks respectively hooked in said mounting holes of said heat sink.

3. The LED lamp holder as claimed in claim 1, wherein said heat sink comprises at least one tie hole disposed in said recessed top end, and at least one tie screw respectively mounted in said at least one tie hole to affix a lamp base to said hollow bottom end of said heat sink.

4. The LED lamp holder as claimed in claim 1, wherein said heat sink comprises a hollow block disposed in said recessed top end, said hollow block defining a plurality of peripheral walls each holding one said LED chip.

5. The LED lamp holder as claimed in claim 4, wherein said heat sink further comprises a wire hole located on said hollow block.

6. The LED lamp holder as claimed in claim 1, wherein said heat sink further comprises a plurality of inner threads located on an inside wall of said hollow bottom end for the mounting of a lamp base.

7. The LED lamp holder as claimed in claim 1, wherein said lampshade is fastened to said recessed top end of said heat sink by an adhesive bonding technique.

* * * * *